US009273514B2

(12) United States Patent
Hodgson et al.

(10) Patent No.: US 9,273,514 B2
(45) Date of Patent: Mar. 1, 2016

(54) EXTERIOR MOUNTED WINDOW TREATMENT SYSTEM AND WINDOW ASSEMBLY INCLUDING THE SAME

(71) Applicant: Marvin Lumber and Cedar Company, Warroad, MN (US)

(72) Inventors: Peter Hodgson, Warroad, MN (US); Kevin Wayne Bruce, Warroad, MN (US); Thomas J. Heppner, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 14/304,500

(22) Filed: Jun. 13, 2014

(65) Prior Publication Data

US 2014/0366469 A1 Dec. 18, 2014

Related U.S. Application Data

(60) Provisional application No. 61/834,727, filed on Jun. 13, 2013.

(51) Int. Cl.

| | |
|---|---|
| ***E06B 3/964*** | (2006.01) |
| ***E06B 9/58*** | (2006.01) |
| ***E06B 9/42*** | (2006.01) |
| *E06B 9/24* | (2006.01) |
| *E04F 10/06* | (2006.01) |
| *E04F 10/02* | (2006.01) |
| *E06B 7/08* | (2006.01) |
| *E06B 1/02* | (2006.01) |
| *E06B 1/62* | (2006.01) |

(52) U.S. Cl.

CPC ... *E06B 9/58* (2013.01); *E06B 9/42* (2013.01); *E04F 10/02* (2013.01); *E04F 10/0607* (2013.01); *E06B 1/02* (2013.01); *E06B 7/08* (2013.01); *E06B 9/24* (2013.01); *E06B 2001/628* (2013.01)

(58) Field of Classification Search

CPC ..... E06B 9/24; E06B 2001/628; E06B 10/02; E06B 10/0607; E06B 7/08

USPC ..... 52/204.62, 745.15, 202.203, 741.3; 49/87.1, 64, 380, 464, 74.1; 160/340, 160/201, DIG. 17

See application file for complete search history.

(56) References Cited

U.S. PATENT DOCUMENTS

| | | | | |
|---|---|---|---|---|
| 2,651,085 | A * | 9/1953 | Kopp | 49/64 |
| 2,970,643 | A * | 2/1961 | Adamsky | 160/121.1 |
| 4,979,552 | A * | 12/1990 | van der Zanden | 160/107 |

(Continued)

FOREIGN PATENT DOCUMENTS

| | | |
|---|---|---|
| WO | WO2011156395 | 12/2011 |
| WO | WO-2011156395 A1 | 12/2011 |

*Primary Examiner* — Chi Q Nguyen

(74) *Attorney, Agent, or Firm* — Schwegman Lundberg & Woessner, P.A.

(57) ABSTRACT

A window assembly includes a window frame and an exterior window treatment system mounted to the window frame. The exterior window treatment system has a treatment storage housing configured to receive an exterior window treatment movable between a stored position within the treatment storage housing and a deployed position extending from the treatment storage housing. The window system also includes at least one guide for guiding the window treatment between the stored position and the deployed position. The window assembly includes at least one interface frame coupled with each of the treatment storage housing and the at least one guide for engaging the window treatment system to the window frame.

30 Claims, 16 Drawing Sheets

(56) References Cited

U.S. PATENT DOCUMENTS 5,566,736 A * 10/1996 Crider et al. ..... 160/121.1
7,267,156 B2 * 9/2007 Byeon ..... 160/121.1
7,806,160 B2 * 10/2010 Byeon ..... 160/85
2011/0108205 A1 * 5/2011 Levin ..... 160/84.01
2012/0291963 A1 * 11/2012 Marocco ..... 160/120
2013/0081766 A1 * 4/2013 Bourdon ..... 160/127
2013/0160954 A1 * 6/2013 Bolton, III ..... 160/84.04

* cited by examiner

EXTERIOR MOUNTED WINDOW TREATMENT SYSTEM AND WINDOW ASSEMBLY INCLUDING THE SAME

CLAIM OF PRIORITY

This patent application claims the benefit of priority, under 35 U.S.C. Section 119(e), to U.S. Provisional Patent Application Ser. No. 61/834,727, entitled "Exterior Mounted Window Treatment System and Window Assembly Including the Same," filed on Jun. 13, 2013, which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company (d/b/a Marvin window or door); Warroad, Minn. All Rights Reserved.

TECHNICAL FIELD

This document pertains generally, but not by way of limitation, to window or door treatments and systems and methods for attaching the window or door treatments to doors and windows.

BACKGROUND

Home exteriors often include exterior window or door treatments such as exterior blinds or shades. Exterior window or door treatments for blinds or shades often include a roller or a rail from which the blinds or shades are suspended. The roller or rail is typically mounted to an upper portion of the window or door frame or to an exterior wall of the house above the window or door frame by nails, bolts or brackets. The roller or rail typically extends outward from the plane of the exterior wall to position the blinds or shades in front of the window or door. Certain exterior window or door treatments include a storage box fitted over the roller or rail to provide weather protection for the roller, rail or other components such as motorized elements for positioning the blinds or shades. Certain exterior window or door treatments include guides that direct the deploying blind or shades into a correct fully deployed position. The guides are often mounted to the sides of the window or door frame or along the sides of the window or door frame.

Exterior window or door treatments are frequently installed after the window or door has been installed in the exterior wall. In particular, exterior window and door treatments are often installed as part of remodeling projects for existing windows or doors. Similarly, consumers often pair a selected door or window with a selected exterior window or door treatment. Accordingly, the exterior window treatments are often provided as a kit in which the various components of the exterior window treatments are provided with adhesive strips or other fastening elements to secure the components to the exterior wall or the window or door frame. As the exterior window treatments are not installed with the original window or door, the exterior window treatments often have large mechanical brackets and similar features for receiving fasteners for securing the window treatment to the exterior wall or window or door frame thereby increasing the footprint of the exterior window treatment. Similarly, the exterior window treatments are often misaligned with the edges of the existing window or door frame resulting in an undesirable aesthetic appearance or difficult operation of the treatments.

OVERVIEW

The present inventors have recognized, among other things, that a problem to be solved can include attaching exterior window or door treatment systems to existing window or doors such that the window or door treatment systems appear integral to the window or door with a minimal visible footprint. In an example, the present subject matter provides a solution to this problem, such as by providing an exterior window treatment system having a frame engagement feature and a window frame engagable to the frame engagement feature or having attached cladding having an interface engagement feature corresponding to the frame engagement feature. Upon engagement, the exterior window or door treatment integrates with the window or door to form part of the decorative exterior appearance of the window or door while providing the blinds or shades for the window or door. In certain examples, the interface features of the window or door frame couple with a treatment storage housing containing an exterior window or door treatment, treatment guide, blinds or shades.

A window system, according to an example, includes a window frame, a window sash received within the window frame and an exterior window treatment system. The exterior window treatment system includes an exterior window treatment movable between a stored position and a deployed position and a treatment storage housing containing a treatment deployment assembly for moving the exterior window treatment between the stored position and the deployed position. The exterior window treatment system also includes at least one housing interface frame component coupled to the treatment storage housing and a frame attachment feature configured to operably engage and align the treatment storage housing with the window frame.

An exterior window treatment system for incorporation with a window frame, according to an example, includes an exterior window treatment movable between a stored position and a deployed position and a treatment storage housing containing a treatment deployment assembly for moving the exterior window treatment between the stored position and the deployed position. The exterior window treatment system also includes at least one housing interface frame component coupled to the treatment storage housing and a frame attachment feature configured to operably engage and align the treatment storage housing with the window frame.

A method of integrating an exterior window treatment system with a window frame, according to an example, includes positioning a window frame in a wall opening. The method also includes providing a window treatment housing including an exterior window treatment movable between a stored position and a deployed position and coupling at least one housing interface frame component to the window treatment housing, each housing interface frame component including a frame attachment feature. The method further includes coupling the frame attachment feature to the window frame to attach the window treatment housing to the window frame, wherein the frame attachment feature is configured to align the window treatment housing with the window frame.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
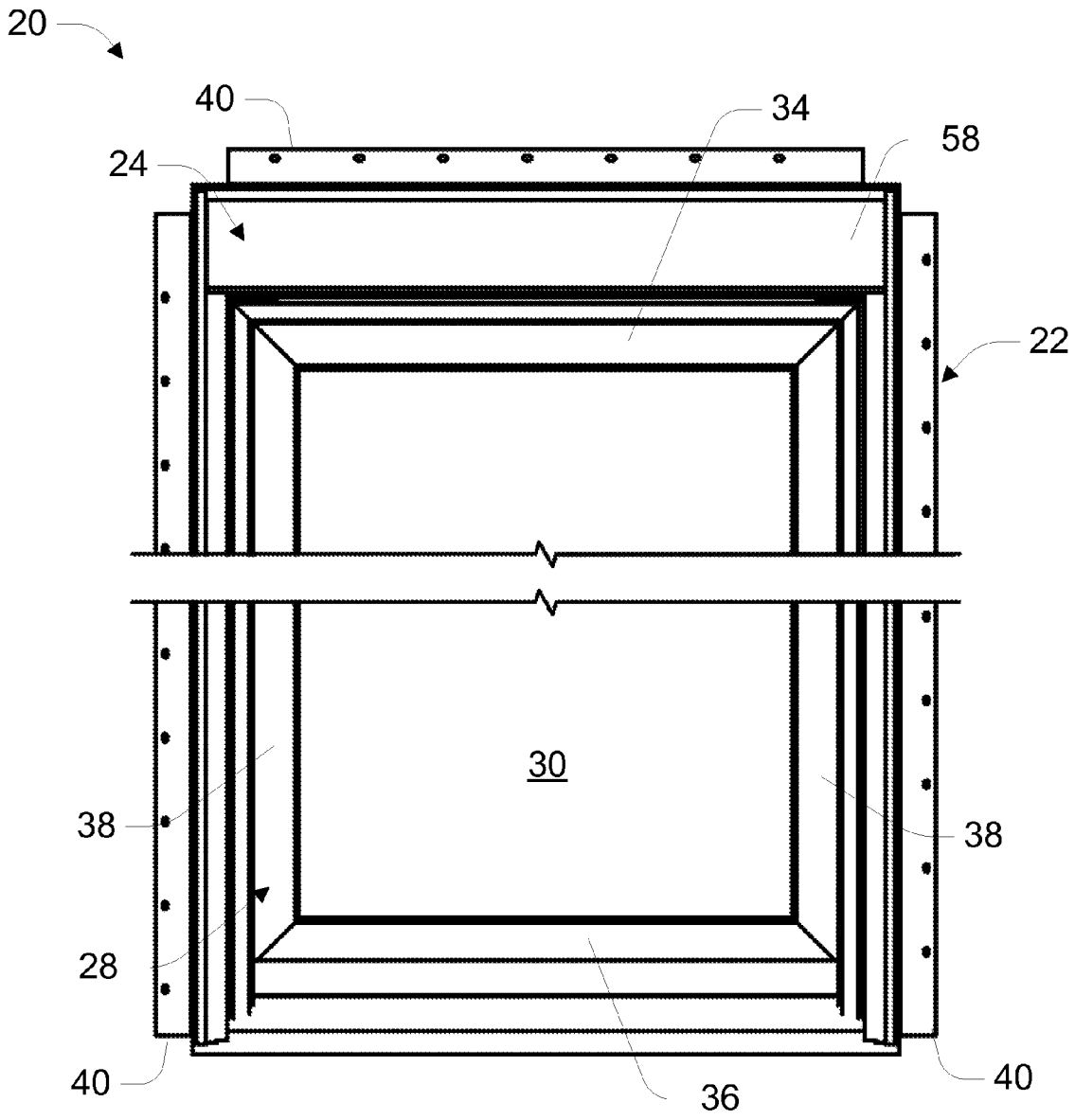
FIG. 1 is a front view of one example of a window assembly including an exterior window treatment system coupled with the window.

As depicted in FIGS. 1-5 and 9-10, a window system 20, according to an example, includes a window assembly 22 and an exterior window treatment system 24 including at least one interface frame component 26, 27 for coupling the exterior window treatment system 24 to the window assembly 22. The window treatment system 24 including a deployable window treatment 32 configured to selectively obscure the window assembly 22 such as by selectively deploying and stowing the deployable window treatment 32. The present subject matter, as discussed, is directed to windows, but is readily applicable to doors and similar structures.

Referring to FIG. 1, the window assembly 22 includes a window frame 28 and a window sash 30 receivable within the window frame 28. In certain examples, the window sash 30 slides within the window frame 28 between at least two positions to open or close the window assembly 22. In another example, the window sash 30 is held within the window frame 28 in a generally fixed position (e.g., as a casement or panel window). The window frame 28 includes a header 34, a sill 36 and a pair of parallel jambs 38 that are each positioned against the corresponding edges of the wall opening. The wall opening for windows is typically rectangular and the header 34, sill 36 and jambs 38 are optionally oriented into a rectangular configuration to correspond to the size and shape of the wall opening. Also as depicted in FIG. 1 and later in FIG. 4, at least one of the header 34, sill 36 and jambs 38 comprises a nailing flange 40 extending from the corresponding header 34, sill 36 or jamb 38. Each nailing flange 40 is configured to receive at least one fastener to secure the corresponding header 34, sill 36 or jamb 38 to the corresponding edge of the wall opening.

Figure 2:
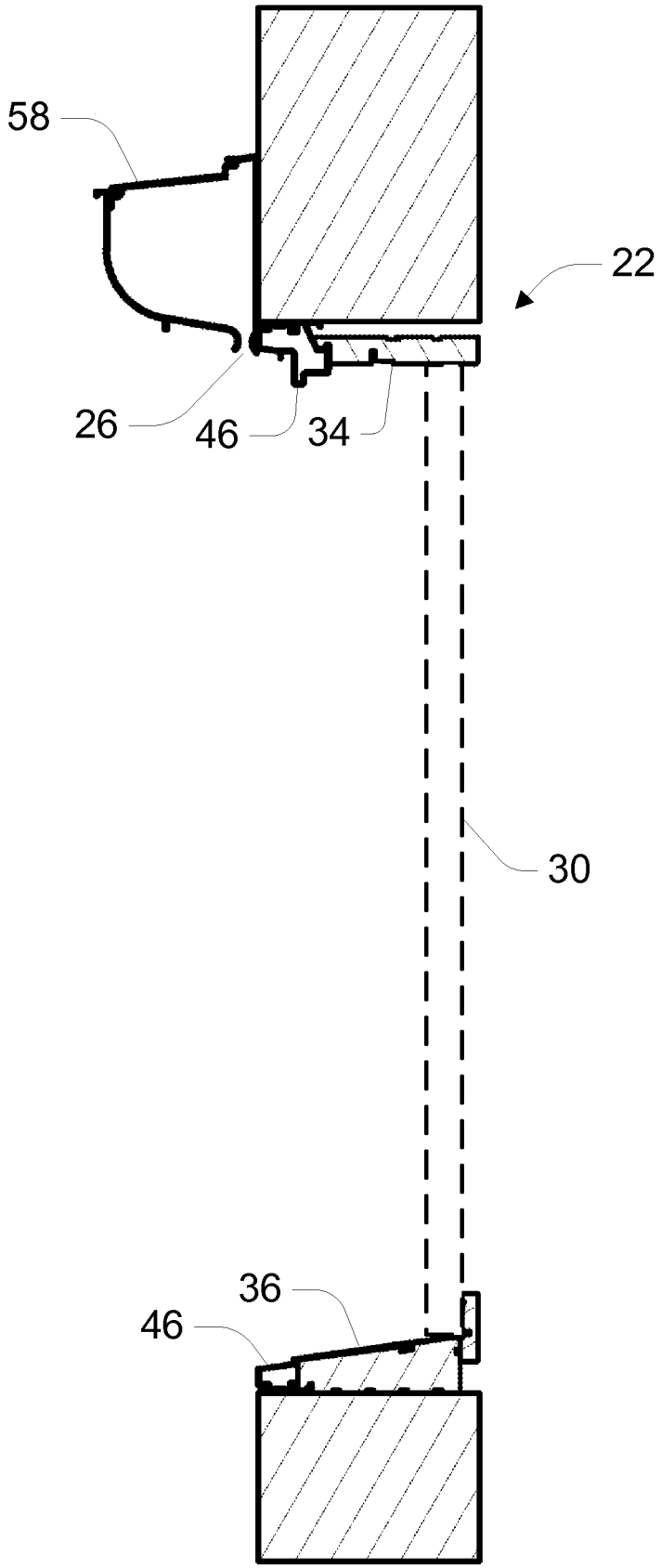
FIG. 2 is a cross sectional view of one example of a treatment storage housing of the exterior window treatment system of FIG. 1.
Figure 3:
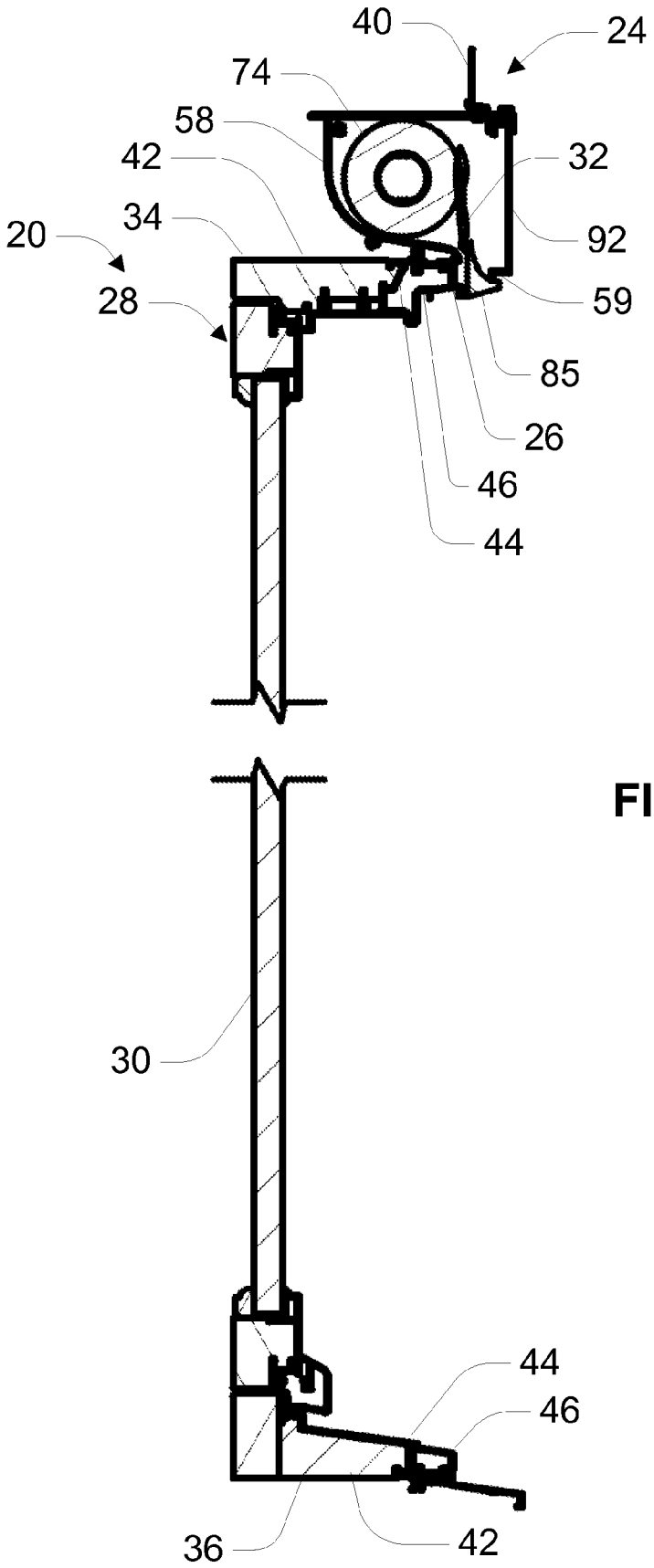
FIG. 3 is a cross sectional side view of another example of a treatment storage housing and an associated interface frame component of the exterior window treatment system of FIG. 1.

As further depicted in FIG. 1 and also depicted in FIGS. 2-3, in an example, the exterior window treatment system 24 includes a treatment housing 58 engagable to at least one of the header 34, sill 36 or jamb 38 of the window frame 28 via an interface frame component 26, 27. As depicted in FIGS. 2-3, the treatment housing 58 is coupled to the header 34 as later depicted in FIG. 6. In other examples, the treatment housing 58 is operably engaged to one or more of the header 34, sill 36 and jambs 38 of the window frame 28.

Also depicted in FIG. 2, the window assembly 22 includes frame cladding 46 mounted to at least one of the header 34 and the sill 36. In an example, the frame cladding 46 is also coupled with the jambs 38 of the window frame 28, as later depicted in at least FIG. 9. The frame cladding 46 is configured to mechanically couple the housing interface frame component 26 with the window frame 28 as depicted in FIG. 2 and a guide interface frame component 27 with the window frame 28 as later depicted in at least FIG. 9. The frame cladding 46 is optionally configured to cover at least a portion of the header 34, sill 36, jambs 38, interface frame component 26, 27 or other mechanical component of the window system 20 to provide a desired aesthetic appearance or to shield the components from inclement weather or moisture. The frame cladding 46 is attached to the window frame 28 during the initial installation of the window frame 28 within the wall opening or subsequently installed after the window frame 28 is installed within the wall opening.

In certain examples, at least one of the header 34, sill 36 and jambs 38 includes an edge 44 (proximate an edge of the wall opening). In an example, the frame cladding 46 is attached to at least one of the corresponding header 34 or sill 36, as depicted in FIG. 3, or jamb 38, as later depicted in FIG. 9, along the edge 44 of the projecting portion 42.

Figure 4:
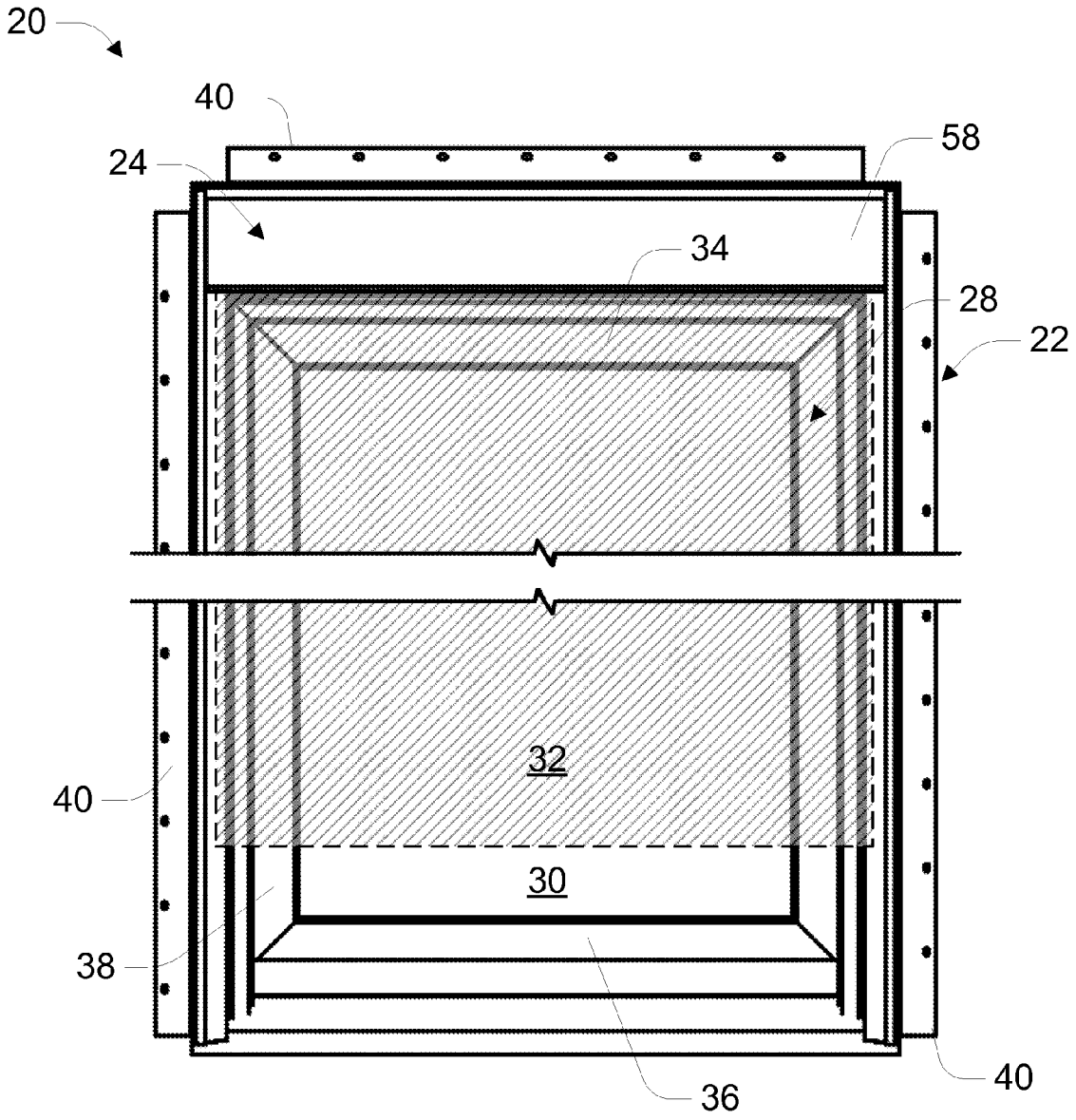
FIG. 4 is a front view of the window system of FIG. 1 with the exterior window treatment in a partially deployed configuration.
Figure 5:
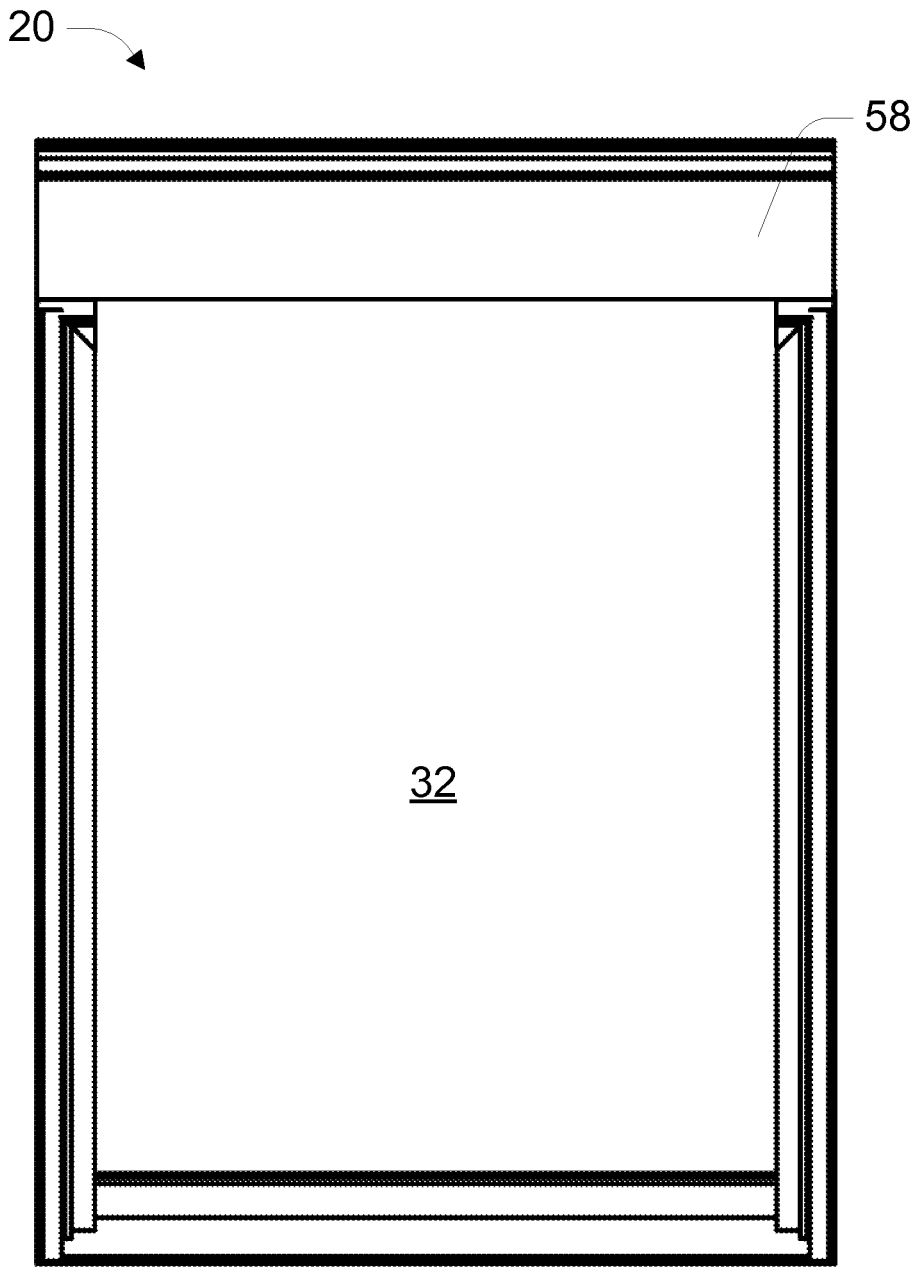
FIG. 5 is a front view of a window assembly including the exterior window treatment system of FIG. 4 with the window treatment in the fully deployed position.

Referring again to FIG. 3, the exterior window treatment system 24 includes a treatment deployment assembly 74 positioned within the treatment housing 58 and the window treatment 32. The treatment deployment assembly 74 is configured to move the window treatment 32 through a deployment slot 59 in the treatment housing 58 between a stowed position and a deployed position as illustrated in FIGS. 4-5. In the stowed position (illustrated in FIG. 3), the window treatment 32 is received within the treatment housing 58. As depicted in FIG. 3, the treatment housing 58 is positioned along one or more of the header 34 and jambs 38. In other examples, the treatment housing 58 is optionally positioned along one or more of the header 34, the sill 36 or jambs 38. In the stowed position, at least one side of the window frame 28 and the sash 30 is entirely or partially revealed. In the deployed position, the window treatment 32 is positioned to entirely or partially obscure the window sash 30 as depicted in FIGS. 4 and 5 (e.g., partially and fully deployed, respectively).

As depicted in FIG. 3, the window treatment 32 includes, in one example, a blind and the treatment deployment assembly 74 includes a roller configured to rotate to move the window treatment 32 between the deployed and retracted positions. Optionally, the treatment deployment assembly 74 is automated or manually rotated to deploy and retract the window treatment 32 from the treatment housing 58. In yet other examples, the window treatment 32 includes, but is not limited to, vertical blinds, horizontal blinds, roman shades, cellular shades, louvered blinds or the like. The treatment deployment assembly 74 includes a deployment mechanism for deploying the corresponding window treatment 32 (e.g., a housing configured to retain the window treatment 32 in its retracted position and facilitate its deployment). Optionally, the treatment housing 58 is incorporated with the housing interface frame component 26. For instance, the window treatment 32 is withdrawn into a compressed configuration (in the manner of a cellular shade or the like) and held along the housing interface frame component 26 (e.g., along at least one of the members of the interface frame component 26).

Figure 6:
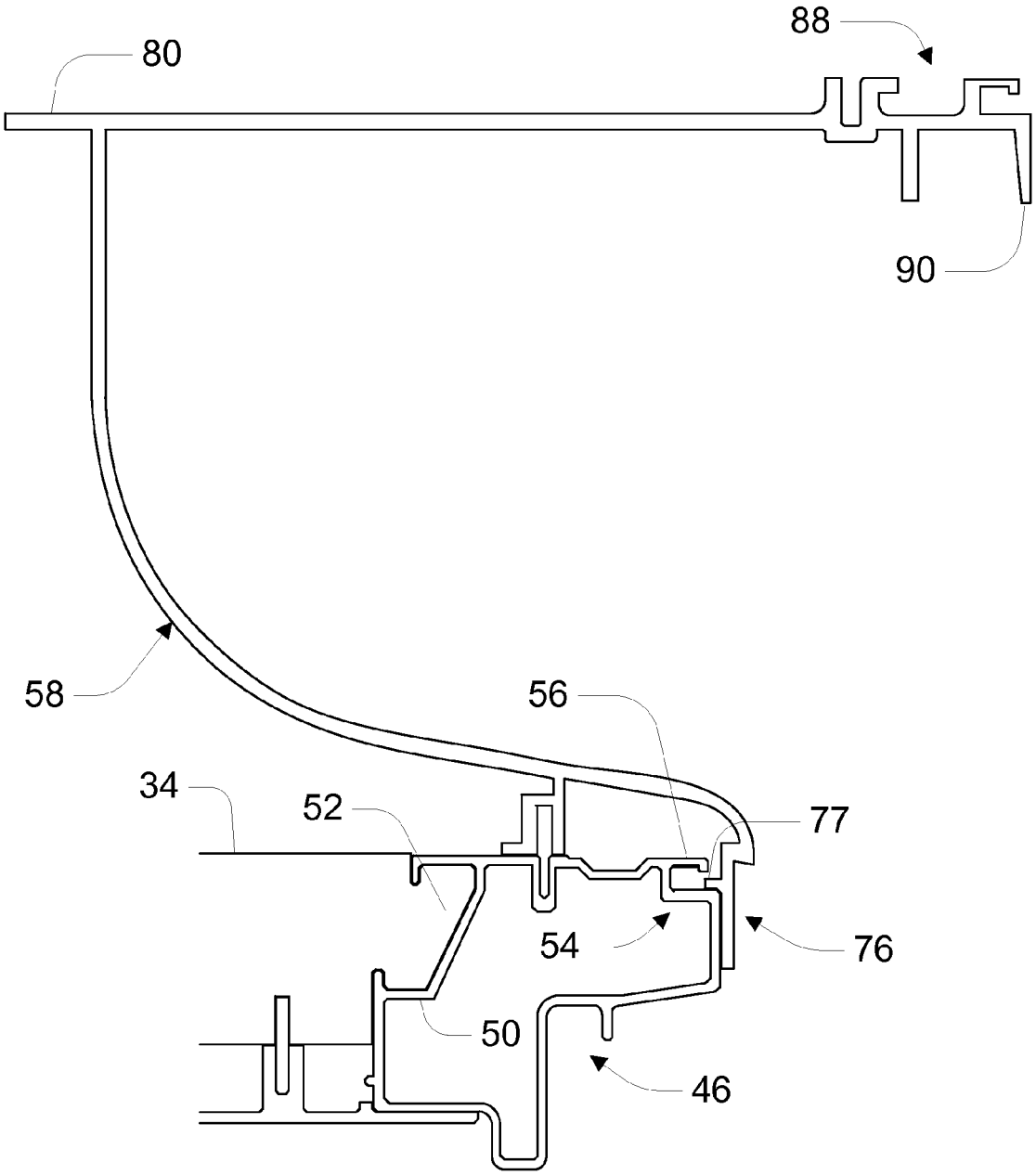
FIG. 6 is a detailed cross sectional view of one example of a treatment storage housing and an associated interface frame component of the exterior window treatment system of FIG. 1.
Figure 7:
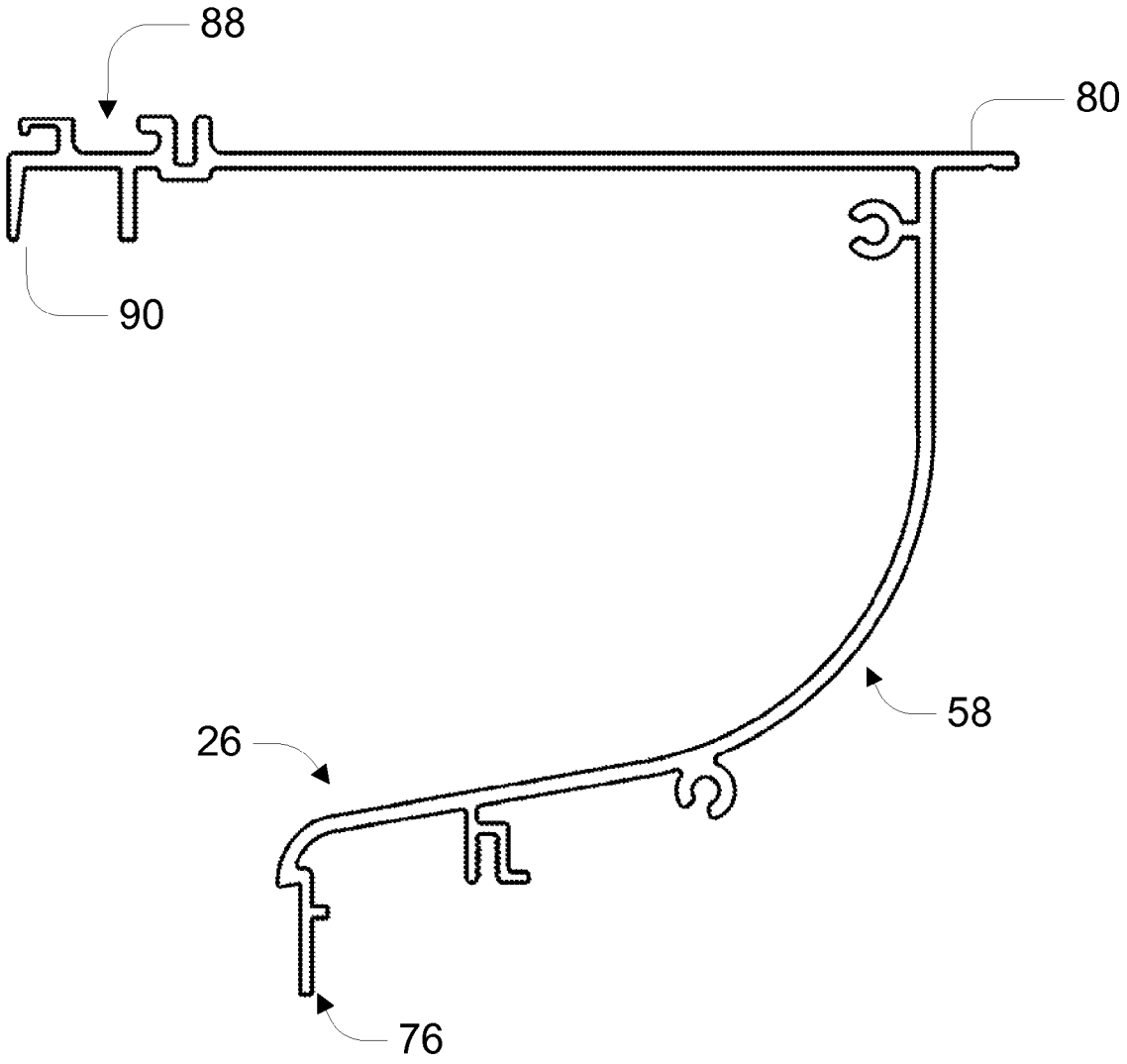
FIG. 7 is a cross sectional view of another example of a treatment storage housing and an associated interface frame component.

FIGS. 6-7 shows one example of the treatment housing 58 including an integrated frame component configured to couple and align the storage housing 58 with the window frame 28 (including frame cladding 46). In an example, housing interface frame component 26 is integrated with the treatment housing 58 and includes at least one frame attachment feature 76 for coupling with the frame cladding 46 to secure the treatment housing 58 to the window frame 28. The frame attachment feature 76 secures the treatment housing 58 to the window frame 28, while aligning the window treatment system 24 with the window sash 30 and the frame 28 to provide aesthetically pleasing and functional alignment. In an example, the frame attachment feature 76 includes a protrusion 77 engagable to a kerf 56 of the frame cladding 46 attached to the header 34 (or other window frame member) to align and secure the treatment housing 58 with the header 34. A fastener can be driver through the frame attachment feature 76 to secure the treatment housing 58 to the cladding 46.

Figure 8:
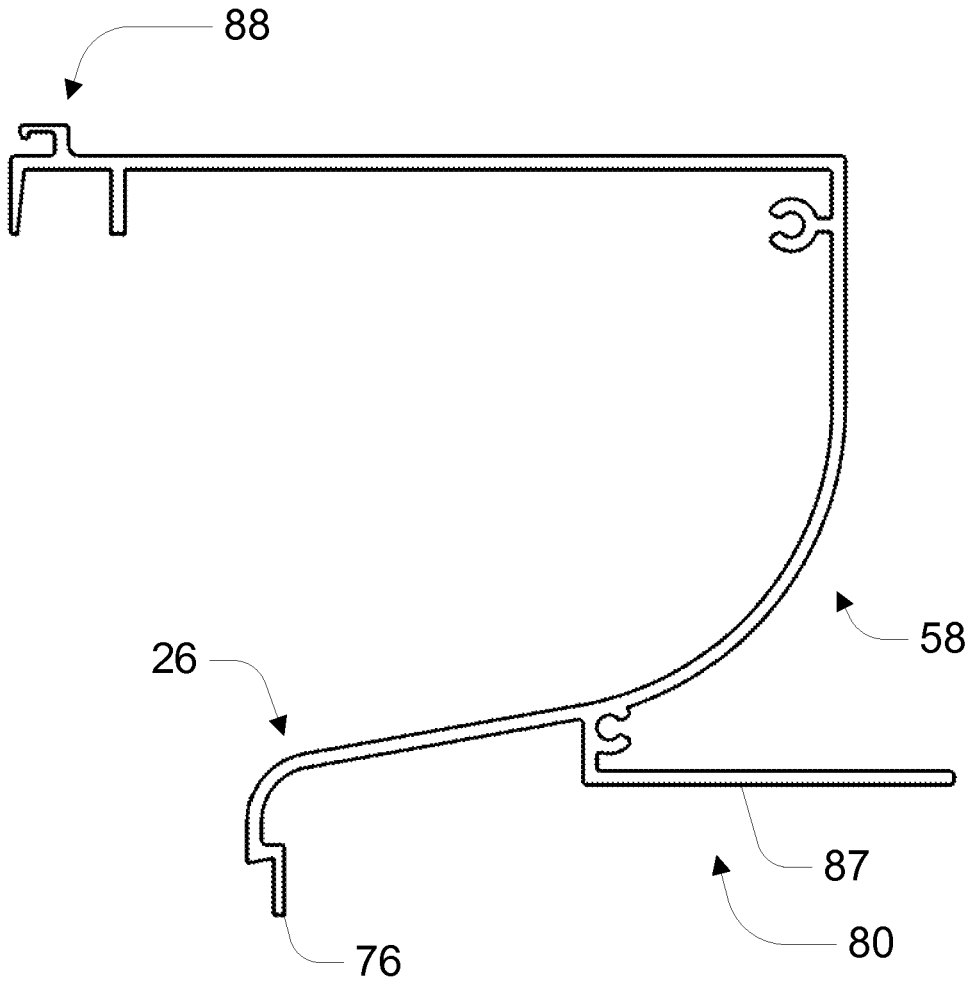
FIG. 8 is a cross sectional view of another example of a treatment storage housing and an associated interface frame component.

Alternatively, as depicted in FIG. 8, the housing interface frame component 26 includes the frame attachment feature 76 without a protrusion for receiving a fastener to secure the treatment housing 58 directly to the window frame 28 or frame cladding 46. For instance, the fastener is driven through frame attachment feature 76 into the corresponding portion of the window frame 28 or frame cladding 46. As depicted in FIG. 8, in certain examples, the second mounting feature 80 includes an engagement element 87 provided at different vertical positions (according to machining or molding) to engage the header 34 (or other window frame 28 component) to further support and align the exterior window treatment housing 58. In other examples, the frame attachment feature 76 optionally defines a hole or slot through which the fastener is partially inserted to secure the treatment housing 58 to the window frame 28 or frame cladding 46. As will be described herein, the frame attachment feature 76 is coupled with an interface engagement feature 54 (See FIG. 6).

Figure 16:
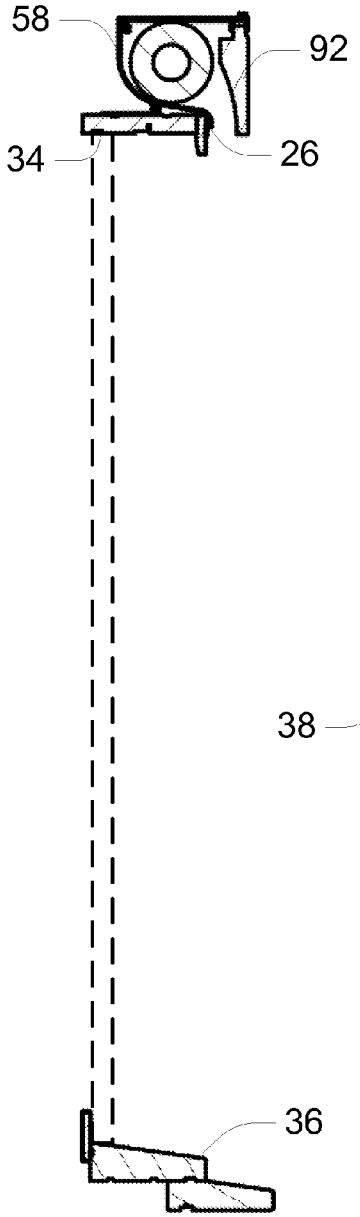
FIG. 16 is a cross sectional side view of one example of a treatment storage housing and a guide interface frame component of the exterior window treatment system of FIG. 14.
Figure 17:
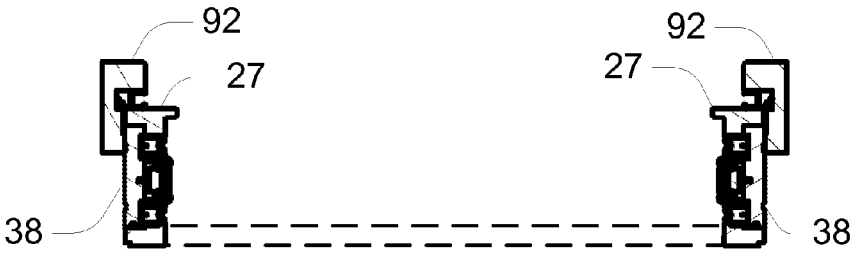
FIG. 17 is a cross sectional top view of one example of a window treatment guide and an associated interface frame of the exterior window treatment system of FIG. 1.

Also as depicted in FIGS. 6-7, in an example, the exterior window treatment housing 58 includes a secondary mounting feature 80 for providing a second engagement point for the exterior window treatment housing 58. The secondary mounting feature 80 provides a second engagement and alignment point between the window assembly 22 and the exterior window treatment housing 58. In an example, the secondary mounting feature 80 is configured to receive a fastener to secure the exterior window treatment housing 58 to the window frame 28 or the surrounding wall. In another example, the secondary mounting feature 80 is configured to engage with a mounting bracket affixed to the surrounding wall. Referring again to FIGS. 6-7, in an example, the exterior window treatment housing 58 also includes at least one exterior cover engagement feature 88 having a bracket 90 for engaging a corresponding feature of at least one exterior cover element (one example of which is shown with exterior cover element 92 in FIG. 16). The exterior cover element 92 includes, but limited to exterior cladding, facades, siding, casing and other exterior covers for the window frame 28 and window treatment systems 24. The exterior cover engagement feature 88 aligns the exterior cover element 92 with the exterior window treatment housing 58, which is aligned with the window frame 28 such that the exterior cover element 92 has the appropriate aesthetic and functional alignment (e.g., to level the cladding relative to the window frame 28, window sash 30 and the window treatment 32).

Figure 9:
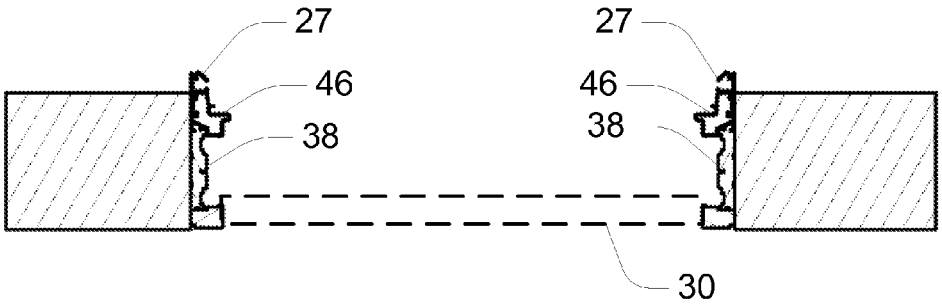
FIG. 9 is a cross sectional top view of one example of a window treatment guide and an associated interface frame of the exterior window treatment system of FIG. 1.
Figure 10:
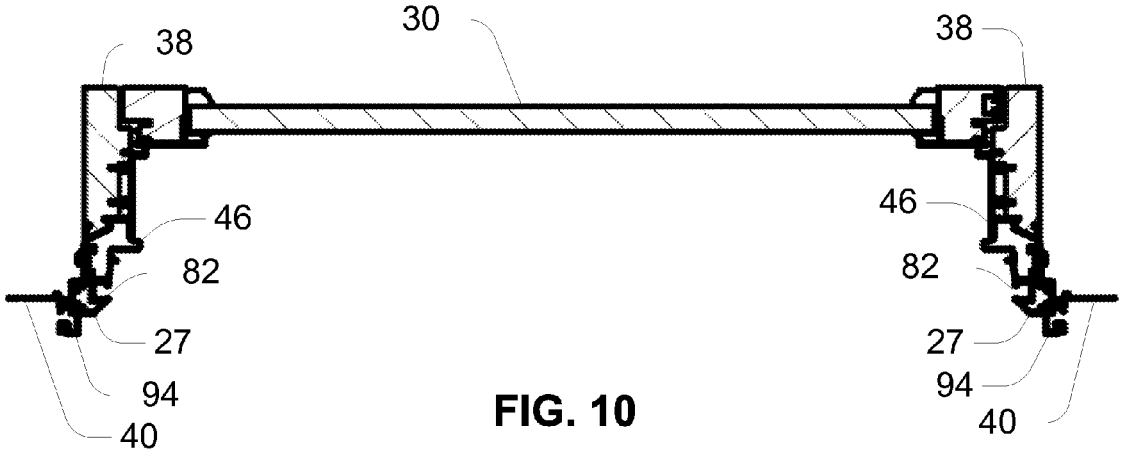
FIG. 10 is a cross sectional top view of one example of a window treatment guide and an associated interface frame of the exterior window treatment system of FIG. 1 with the exterior cover affixed.

As depicted in the top cross-sectional view of FIGS. 9-10, the exterior window treatment system 24 also includes at least one guide interface frame component 27 (including the treatment guide), which coupled to the frame cladding 46 attached to the jambs 38. In an example, a guide interface frame component 27, such as depicted in FIG. 9, attached to the jambs 38 is operably coupled to a housing interface frame component 26, such as depicted in FIG. 6, of the exterior window treatment housing 58. In another example, the interface frame components 26, 27 are distinct elements. Referring to FIG. 10, the at least one guide interface frame component 27 includes at least one integrated treatment guide 82 for engaging the window treatment 32 to facilitate the transition between the deployed position and the retracted position as depicted in FIGS. 4-5. As shown in FIG. 10, the exemplary integrated treatment guide 82 includes, but is not limited to, a rail, groove, track, or the like configured to guide the window treatment 32.

Figure 11:
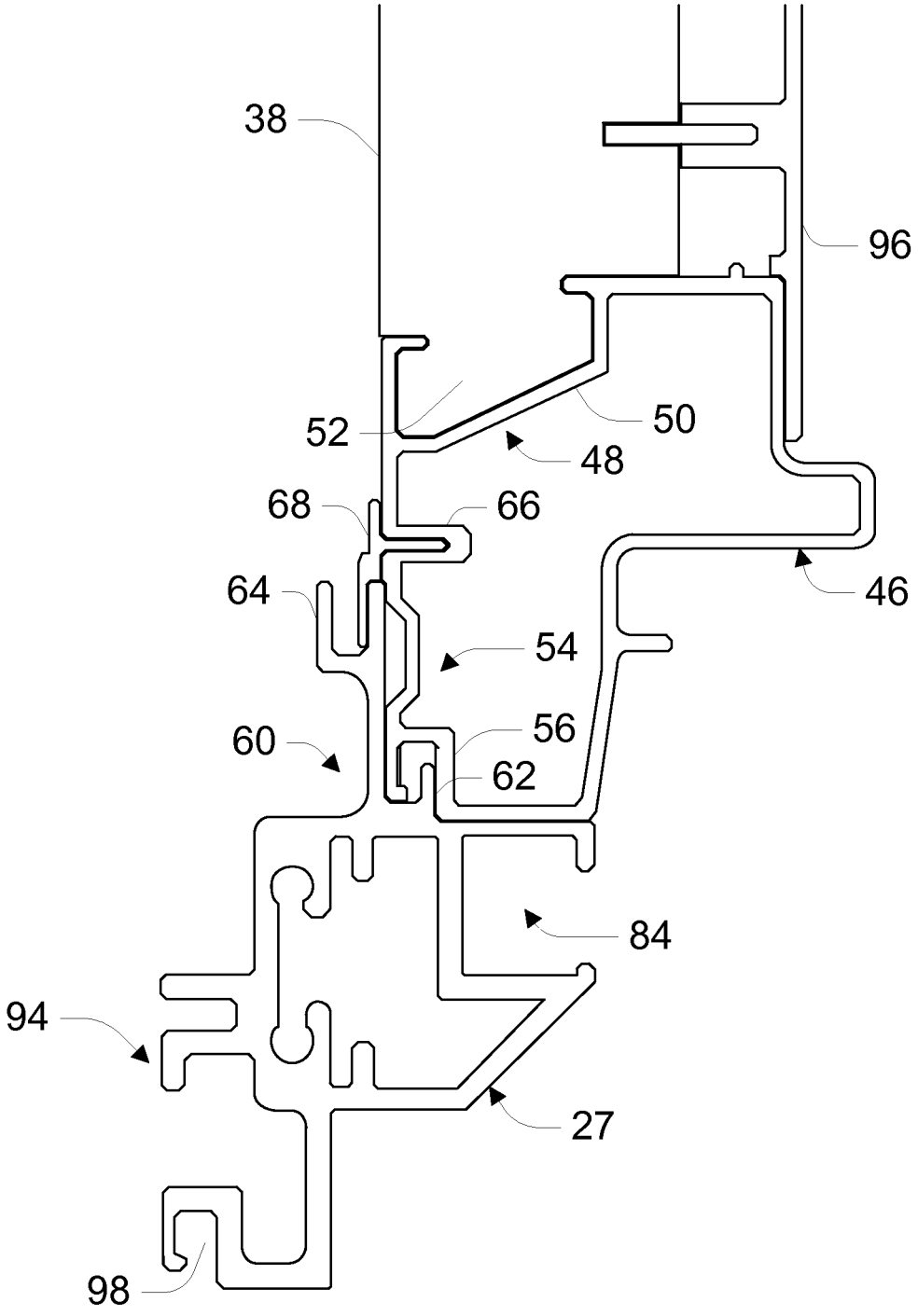
FIG. 11 is a detailed cross sectional view of one example of a window treatment guide of the exterior window treatment system of FIG. 1.
Figure 12:
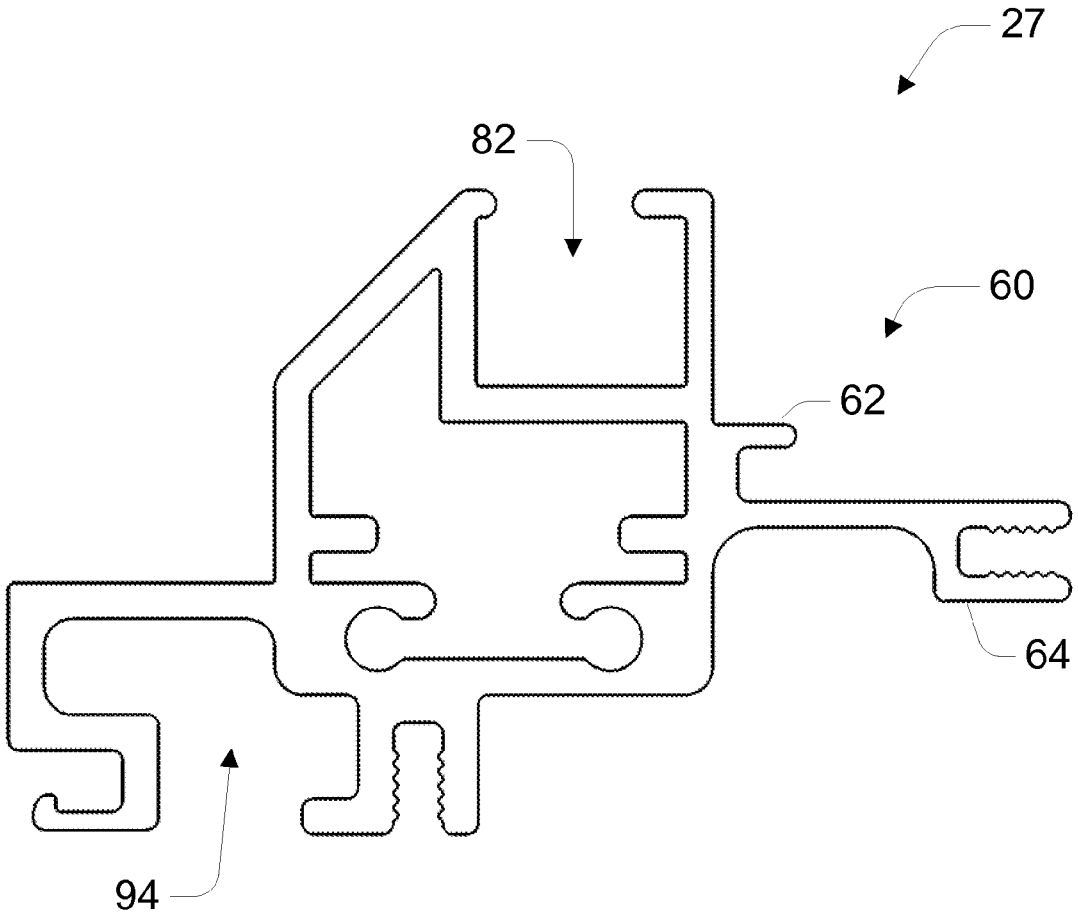
FIG. 12 is a cross sectional view of one example of an interface frame component.

FIGS. 11-12 show a detailed cross sectional view of the treatment guide 82 and guide interface frame component 27, previously described herein. The treatment guide 82 includes a channel 84. The walls surrounding the channel 84 engage a portion of the window treatment 32 to prevent lateral movement of the window treatment 32 (relative to the window frame 28) as the window treatment 32 is moved between the deployed and refracted positions. In certain examples, the channel 84 is engagable to a drop bar 85 (or other linear element engaged to an edge of the window treatment 32 for weighting the window treatment 32) attached to the window treatment 32, as depicted in FIG. 3 or the like, to facilitate even deployment over the window treatment 32 or prevent torquing and twisting of the window treatment 32.

Figure 13:
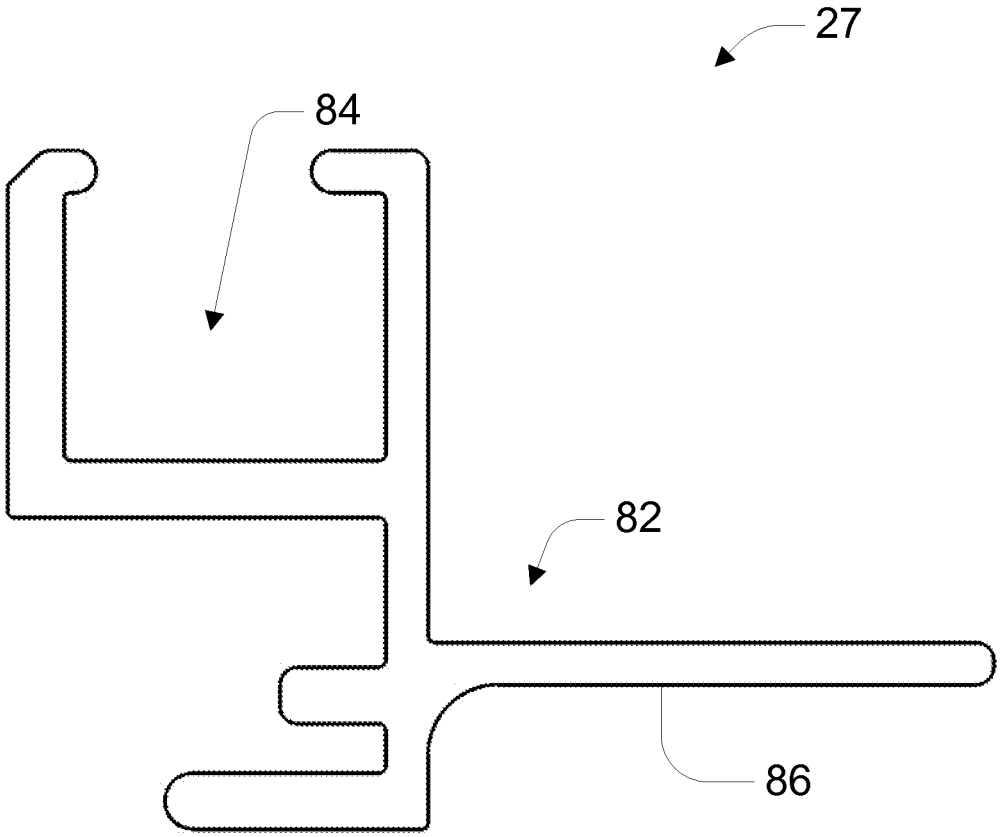
FIG. 13 is a cross sectional view of another example of a treatment guide.
Figure 14:
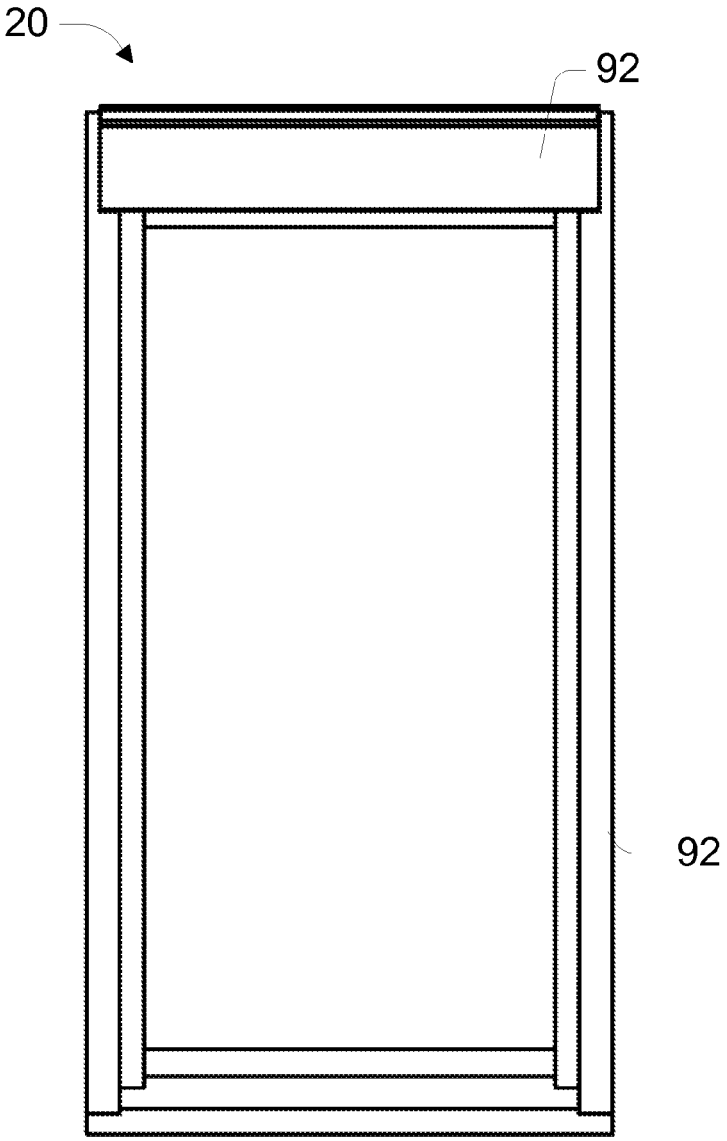
FIG. 14 is a front view of a window assembly including an exterior window treatment system engagable with the window assembly, wherein the exterior window treatment is in a stored position.
Figure 15:
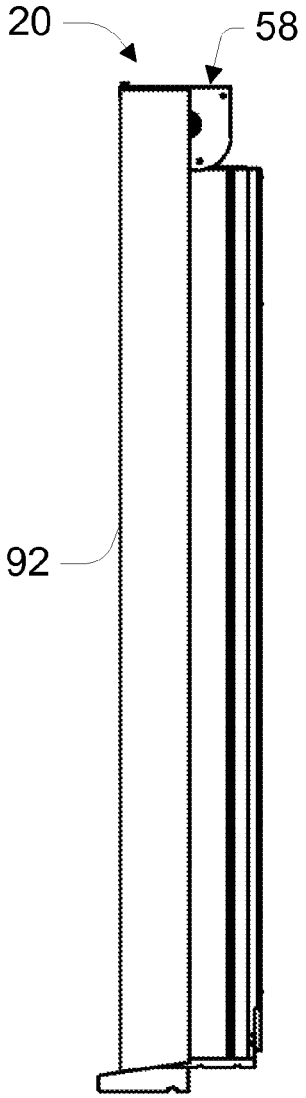
FIG. 15 is a side view of an exterior window treatment system having the treatment storage housing coupled with an external cladding element.

In certain examples, each treatment guide 82 is integrated into the guide interface frame component 27. As depicted in FIG. 13, in certain examples, each treatment guide 82 includes a separate element and at least one bracket 86 for receiving a fastener to mount the treatment guide 82 to the window frame 28 or guide interface frame component 27.

Referring again to the FIG. 11 detailed view of one example of the jamb 38 including the guide interface frame component 27, the frame cladding 46 includes an interface engagement feature 54 for coupling the frame cladding 46 with the guide interface frame component 27. The interface engagement feature 54 includes a kerf 56 for providing an accessible and minimally visible mounting point for the guide interface frame component 27. In addition, the kerf 56 provides an elongated mounting point for the guide interface frame component 27 to align the guide interface frame component 27 on a line parallel to the window sash 30. Stated another way, the interface engagement feature 54 (e.g., including the kerf 56) optionally extends along at least a portion of the jambs 38. The interface engagement feature 54, such as the kerf 56 thereby provides an elongate feature configured to receive and align the guide interface frame component 27 there along. In certain examples, protective stripping (optional) is insertable within the kerf 56 prior to engagement with the guide interface frame component 27 (e.g., where the exterior window treatment system 24 is not installed) to conceal the kerf 56.

As further shown in FIG. 11, in an example the guide interface frame component 27 includes a frame interface feature 60 for attaching the guide interface frame component 27 to the window frame 28. The frame engagement feature 48 includes a projection 62 received within the kerf 56 of the frame cladding 46 to secure the guide interface frame component 27 to the window frame 28 via the frame cladding 46. In certain examples, the projection 62 is elongated (extends into and out of the page) and corresponds to all or a portion of the length of the kerf 56. Optionally, the projection 62 includes a plurality of projections 62 received at distributed locations along the kerf 56 to prevent misalignment of the guide interface frame component 27 relative to the window frame 28. The cooperation of the projection 62 and the kerf 56 also aligns the treatment guide 27 with the window frame 28 and the window sash 30.

Referring again to FIG. 11, in an example, the guide interface frame component 27 includes a plug port 64 and the frame cladding 46 includes a corresponding plug port 66, each receiving a portion of a plug 68 to further retain the guide interface frame component 27 along the frame cladding 46 (e.g., supplemental to the kerf 56 and projection 62). In another example, the plug 68 aligns the guide interface frame component 27 with the window frame 28 via the frame cladding 46. In other words, the plug 68 and the plug port 64 provide a supplemental or alternative mechanism to align the guide interface frame component 27 with the window frame 28. In certain examples, the plug assembly reinforces the engagement of the frame interface feature 60 (e.g., the projection 62) with the kerf 56. In other examples, the guide interface frame component 27 includes one or more of the frame interface feature 60 and plug assembly.

Figure 18:
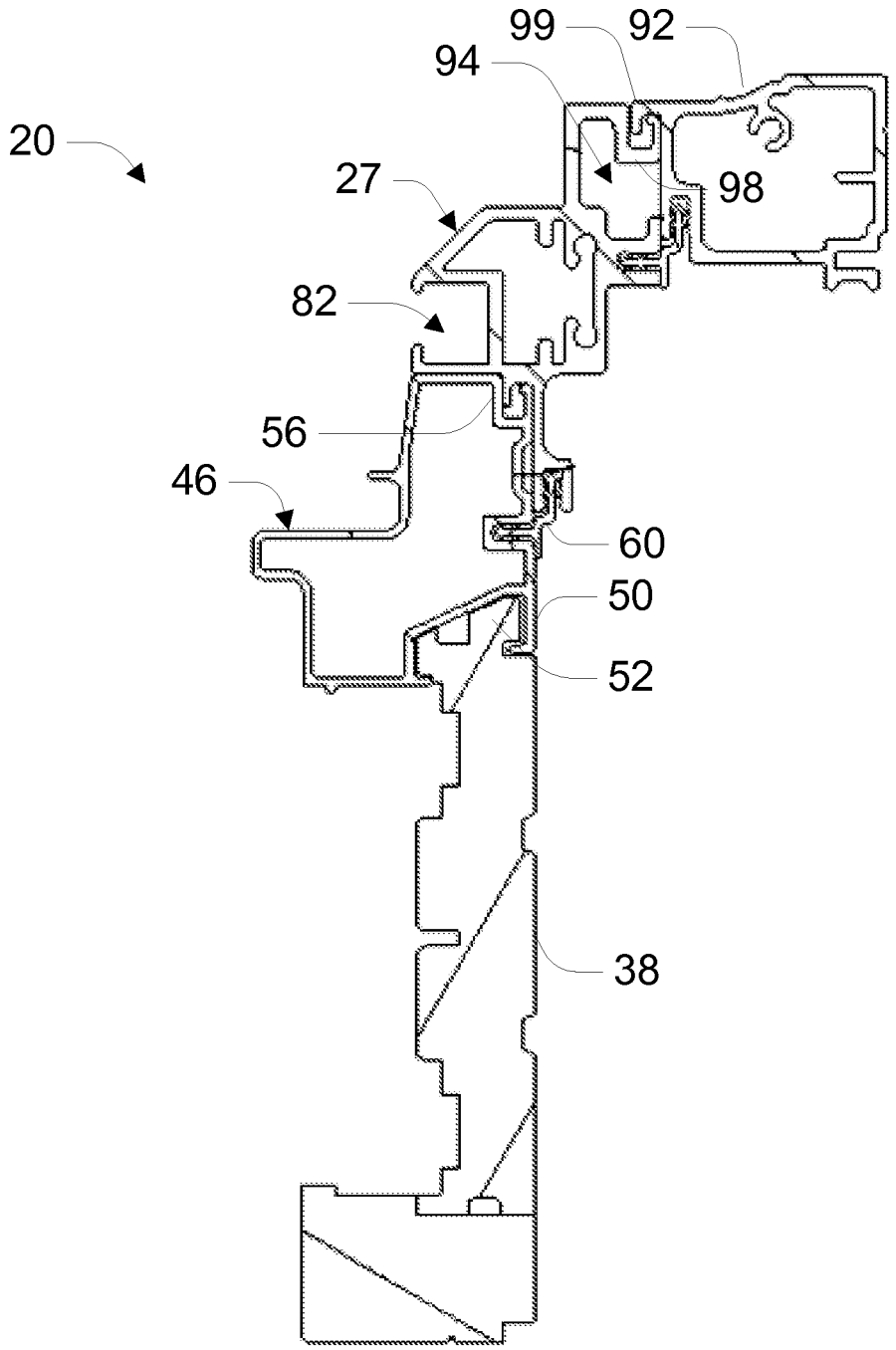
FIG. 18 is a detailed cross sectional view of another example of a window treatment guide of the exterior window treatment system of FIG. 1.

As further shown in FIG. 11, in an example, guide interface frame component 27 also includes an exterior cover engagement feature 94. The exterior cover engagement feature 94 provides an optional coupling feature for the installation of cladding or other window components. For instance, the exterior cover engagement feature 94 includes at least one kerf 98, a recess, post, groove or the like for engaging at least one corresponding exterior engagement feature 99 of exterior cover element 92 as illustrated in FIG. 18. The exterior cover element 92 conceals the guide interface frame component 27 and other mechanical features of the window system 20 to provide an aesthetic appearance and to protect against inclement weather and moisture. Optionally, supplemental window components are coupled along the exterior cover engagement feature 94 including, but not limited to, casings or trims.

FIG. 11 also provides a detailed view of the frame cladding 46, for instance the interface between the frame cladding 46 and a jamb 38 (and the frame 28 generally). The exemplary frame cladding 46 includes a frame engagement feature 48 for engaging at least one of the header 34, sill 36 or jambs 38 to secure the frame cladding 46 to the window frame 28. The frame cladding 46 is attached to the window frame 28 during the installation of the window frame 28 within the wall opening or is subsequently installed after the window frame 28 is installed. In an example, a bracket 96 is configured for coupling with the jamb 38 and the bracket 96 is engagable to the frame cladding 46 for fixing and aligning the frame cladding 46 to the window frame 28. In another example, at least one of the header 34, sill 36 and jambs 38 includes a cladding engagement feature 52 engagable by the frame engagement feature 48 positioned on the edge 44 to secure the frame cladding 46 to the header 34, sill 36 or the jambs 38. In this configuration, the frame engagement feature 48 includes a kerf 50 that receives the cladding engagement feature 52 to secure the frame cladding 46 to the header 34, sill 36 or jambs 38 (e.g., where the respective features are provided along the window frame 28).

As depicted in FIGS. 14-18, at least one exterior cover element 92 is coupled to the guide interface frame component 27 or the treatment housing 58. The exterior cover element 92 provides a decorative façade that conceals the interface frame components 26, 27, treatment housing 58 or the like and protects the mechanical components of the window system 20 from moisture and inclement weather. The cladding engagement feature 94 and bracket 99 couple and align the exterior cover element 92 with the window frame 28 to provide an aesthetic appearance as shown in FIG. 18.

Figure 19:
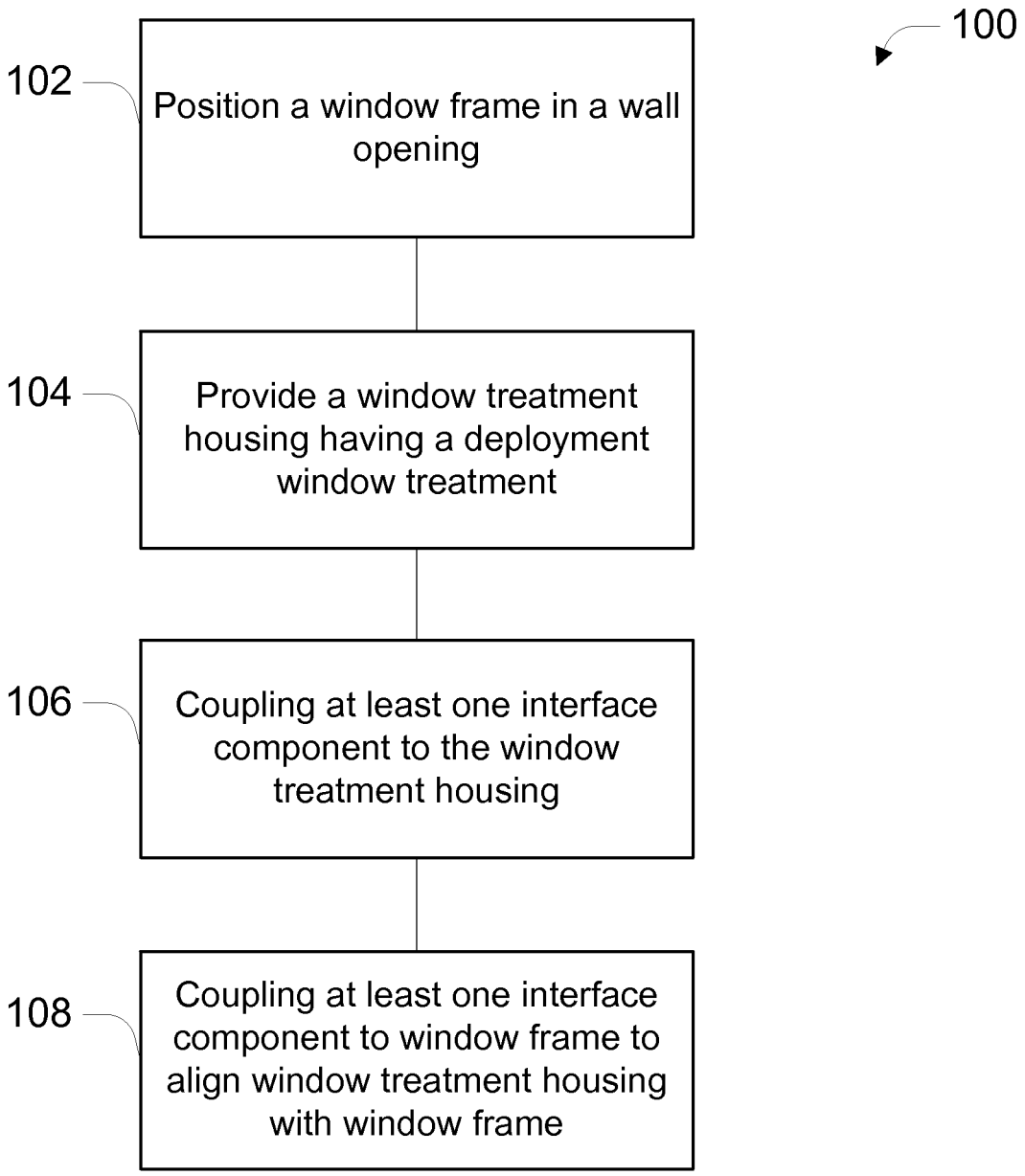
FIG. 19 is a block diagram showing one example of a method for installing an exterior window treatment system.

A method 100 is shown in FIG. 19 for integrating the exterior window treatment system 24 with a window frame 28. At 102, the method 100 includes positioning the window frame 28 in a wall opening, for instance within a rough opening. At 104, the window treatment housing 58 is provided. As described herein, the window treatment housing 58 includes an exterior window treatment 32 movable between a stored position and a deployed position. The method 100 also includes at 106 coupling at least one housing interface frame component 26 to the window treatment housing 58, each housing interface frame component 26 including a frame attachment feature 76 (as shown in FIGS. 7 and 8). In certain examples, the at least one housing interface frame component 26 is integral with the window treatment housing 58. The method includes, at 108, coupling the at least one interface component to the window frame 28 to align the window treatment housing 58 with the window frame 28. For instance, the frame attachment feature 76 shown in FIGS. 7 and 8 couples to the window frame 28 and correspondingly couples the window treatment housing 58 with the window frame 28. As described herein, coupling of the window treatment housing 58 to the frame 28 with the intervening housing interface frame component 26 automatically aligns the window treatment housing 58 with the window frame 28. In certain examples, frame cladding 46 is affixed to the window frame 28. In this configuration, the frame cladding 46 defines an interface engagement feature 54 engagable to the frame attachment feature 76.

VARIOUS EXAMPLES

In a first example, a window system 20, includes a window frame 28, a window sash 30 received within the window frame 28, and an exterior window treatment system 24. The exterior window treatment system 24 including an exterior window treatment 32 movable between a stored position and a deployed position, a treatment housing 58 containing a treatment deployment assembly 74 for moving the exterior window treatment 32 between the stored position and the deployed position, and at least one housing interface frame component 26 coupled to the treatment housing 58 and including a frame attachment feature 76 configured to operably engage and align the treatment housing 58 with the window frame 28.

In a second example, the window frame 28 of the window system 20 of the first example further includes a header 34, a sill 36 and a pair of parallel jambs 38. The treatment housing 58 is coupled to the window frame 28 proximate to the header 34 and oriented parallel to the header 34.

In a third example, the exterior window treatment system 24 of the window system 20 of the second example further includes at least one guide interface frame component 27 coupled to the window frame 28 proximate one of the parallel jambs 38. Each guide interface frame component 27 includes a treatment guide 82 engagable to the window treatment 32 to guide the window treatment 32 between the stored position and deployed position.

In a fourth example, the housing interface frame component 26 of the window system 20 of the third example is coupled to an adjacent guide interface frame component 27.

In a fifth example, the at least one frame interface feature 60 of the window system 20 of first example includes at least one surface of the window frame 28 to maintain alignment of the treatment housing 58 with the window frame 28.

In the sixth example, the window frame 28 of the window system 20 of the first example further includes frame cladding 46 and defines an interface engagement feature 54 engagable by the frame attachment feature 76.

In the seventh example, the interface engagement feature 54 of the window system 20 of the sixth example includes a kerf 56.

In an eight example, the frame attachment feature 76 of the window system 20 of the first example includes a protrusion 77 engagable to the kerf 56 to secure the housing interface frame component 26 to the window frame 28.

In a ninth example, the treatment housing 58 of the window system 20 of the first example is integral to at least one housing interface frame component 26.

In a tenth example, the exterior window treatment housing 58 of the window system 20 of the first example includes a secondary mounting feature 80 configured to engage at least one of the window frame 28 and a portion of a wall adjacent the window frame 28.

In an eleventh example, the exterior window treatment deployment assembly 74 of the window system 20 of the first example includes a spool and the exterior window treatment 32 includes a blind, wherein the spool is rotatable to wrap the blind onto the spool to move the blind into the stored position and unfurl the blind from the spool to the deployed position.

In a twelfth example, the exterior window treatment 32 of the window system 20 of the first example includes at least one exterior cover element 92 engagable to the at least one housing interface frame component 26.

In a thirteenth example, an exterior window treatment system 24 includes an exterior window treatment 32 movable between a stored position and a deployed position, a treatment housing 58 containing a treatment deployment assembly 74 for moving the exterior window treatment 32 between the stored position and the deployed position, at least one housing interface frame component 26 coupled to the treatment housing 58 and including a frame attachment feature 76 configured to operably engage and align the treatment housing 58 with the window frame 28.

In a fourteenth example, the treatment housing 58 of the exterior window treatment system 24 of example thirteen is coupled to the window frame 28 proximate to a header 34 of the window frame 28 and oriented parallel to the header 34.

In a fifteenth example, the exterior window treatment system 24 of the example thirteen further includes at least one guide interface frame component 27 coupled to the window frame 28 proximate a jamb 38 of the window frame 28. Each guide interface frame component 27 includes a treatment guide 82 engagable to the window treatment 32 to guide the window treatment 32 between the stored position and deployed position.

In a sixteenth example, the housing interface frame component 26 of the exterior window treatment system 24 of example thirteen is coupled to an adjacent guide interface frame component 27.

In a seventeenth example, the at least one frame interface feature 60 of the exterior window treatment system 24 of example thirteen includes at least one surface of the window frame 28 to maintain alignment of the treatment housing 58 with the window frame 28.

In an eighteenth example, the exterior window treatment system 24 of example thirteen further includes frame cladding 46 and defines an interface engagement feature 54 engagable by the frame attachment feature 76.

In a nineteenth example, the exterior window treatment system 24 of example thirteen includes an interface engagement feature 54, which includes a kerf 56.

In a twentieth example, the exterior window treatment system 24 of example thirteen where the frame engagement feature 48 includes a protrusion 77 engagable to the kerf 56 to secure the housing interface frame component 26 to the window frame 28.

In a twenty first example, the treatment housing 58 of the exterior window treatment system 24 of example thirteen is integral to at least one housing interface frame component 26.

In a twenty second example, the exterior window treatment housing 58 of the exterior window treatment system 24 of example thirteen includes a secondary mounting feature 80 configured to engage at least one of the window frame 28 and a portion of a wall adjacent the window frame 28.

In a twenty third example, the exterior window treatment system 24 of example thirteen includes a spool and the exterior window treatment 32 includes a blind, wherein the spool is rotatable to wrap the blind onto the spool to move the blind into the stored position and unfurl the blind from the spool to the deployed position.

In a twenty fourth example, the exterior window treatment 32 of the exterior window treatment system 24 of example thirteen includes at least one exterior cover element 92, which is engagable to at least one interface frame component 26.

In a twenty fifth example, a method of integrating an exterior window treatment system 24 with a window frame 28, including positioning a window frame 28 in a wall opening, provides a window treatment housing 58 including an exterior window treatment 32 movable between a stored position and a deployed position. The method also includes coupling at least one housing interface frame component 26 to the window treatment housing 58, each housing interface frame component 26 including a frame attachment feature 76 and coupling the frame attachment feature 76 to the window frame 28 to attach the window treatment housing 58 to the window frame 28. The frame attachment feature 76 aligns the window treatment housing 58 with the window frame 28.

In a twenty sixth example, the method of the twenty fifth example includes coupling at least one guide interface frame component 27 to the window frame 28. Each guide interface frame component 27 includes at least one treatment guide 82 engagable to the exterior window treatment 32 to guide the exterior window treatment 32 between the stored position and the deployed position.

In a twenty seventh example, the method of the twenty sixth example wherein coupling the at least one guide interface frame component 27 to the window frame 28 includes coupling the frame attachment feature 76 to the window frame 28, the at least one guide interface frame component 27 coupled with the frame attachment feature 76. The frame attachment feature 76 aligns the at least one guide interface frame component 27 and the at least one treatment guide 82 with the window frame 28.

In a twenty eighth example, the method of the twenty fifth example includes coupling frame cladding to an edge portion of the window frame 28, the frame cladding 46 including an interface engagement feature 54 engagable by the frame attachment feature 76.

In a twenty ninth example, the method of the twenty fifth example includes coupling an exterior cover element 92 to the at least one housing interface frame component 26.

In a thirtieth example, the method of the twenty fifty example includes positioning a treatment deployment assembly 74 in the treatment housing 58, the treatment deployment assembly 74 including a spool rotatable to move the exterior window treatment 32 between the open position and closed position, the exterior window treatment 32 including a blind.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A window system, comprising:

a window frame;

a window sash received within the window frame; and an exterior window treatment system including:

an exterior window treatment movable between a stored position and a deployed position, a treatment storage housing containing a treatment deployment assembly for moving the exterior window treatment between the stored position and the deployed position, and at least one housing interface frame component coupled to the treatment storage housing and including a frame attachment feature, the frame attachment feature coupled with the window frame aligns the treatment storage housing with the window frame.

2. The window system of claim 1, wherein the window frame includes a header, a sill and a pair of parallel jambs;

wherein the aligned treatment storage housing is coupled to the window frame proximate to the header and oriented parallel to the header according to the frame attachment feature coupled with the window frame.

3. The window system of claim 2, wherein the exterior window treatment system further comprises:

at least one guide interface frame component coupled to the window frame proximate one of the parallel jambs;

wherein each guide interface frame component includes a treatment guide engagable to the window treatment to guide the window treatment between the stored position and the deployed position.

4. The window system of claim 3, wherein the housing interface frame component is coupled to the guide interface frame component.

5. The window system of claim 1, wherein the at least one frame attachment feature comprises at least one engagement element engagable to a corresponding surface of the window frame to maintain alignment of the treatment storage housing with the window frame.

6. The window system of claim 1, wherein the window frame further comprises window cladding coupled to the window frame and defining an interface engagement feature engagable by the frame attachment feature.

7. The window system of claim 6, wherein the interface engagement feature comprises a kerf.

8. The window system of claim 7, wherein the frame attachment feature comprises a protrusion engagable to the kerf to secure the housing interface frame component to the window frame.

9. The window system of claim 1, wherein the treatment storage housing is integral to at least one housing interface frame component.

10. The window system of claim 1, wherein the exterior window treatment housing includes a mounting feature configured to engage at least one of the window frame and a portion of a wall adjacent the window frame.

11. The window system of claim 1, wherein the treatment deployment assembly comprises a spool and the exterior window treatment comprises a blind, wherein the spool is rotatable to wrap the blind onto the spool to move the blind into the stored position and unfurl the blind from the spool to the deployed position.

12. The window system of claim 1, wherein the exterior window treatment includes at least one exterior cover element engagable to the at least one housing interface frame component.

13. An exterior window treatment system for incorporation with a window frame, comprising:

an exterior window treatment movable between a stored position and a deployed position;

a treatment storage housing containing a treatment deployment assembly for moving the exterior window treatment between the stored position and the deployed position; and at least one housing interface frame component coupled to the treatment storage housing and including a frame attachment feature, the frame attachment feature configured to couple the treatment storage housing with the window frame, and the frame attachment feature automatically aligns the treatment storage housing with the window frame when coupled with the window frame.

14. The exterior window treatment system of claim 13, wherein the treatment storage housing is coupled to the window frame proximate to a header of the window frame and oriented parallel to the header.

15. The exterior window treatment system of claim 13, further comprising at least one guide interface frame component coupled to the window frame proximate a jamb of the window frame;

wherein each guide interface frame component includes a treatment guide engagable to the window treatment to guide the window treatment between the stored position and the deployed position.

16. The exterior window treatment system of claim 15, wherein the housing interface frame component is coupled to the at least one guide interface frame component.

17. The exterior window treatment system of claim 13, wherein at least one frame attachment feature comprises at least one engagement element engagable to a corresponding surface of the window frame to maintain alignment of the treatment storage housing with the window frame.

18. The exterior window treatment system of claim 13, further comprising:

window cladding configured to couple to the window frame and defining an interface engagement feature engagable by the frame attachment feature.

19. The exterior window treatment system of claim 18, wherein the interface engagement feature comprises a kerf.

20. The exterior window treatment system of claim 19, wherein a frame attachment feature comprises a protrusion engagable to the kerf to secure the housing interface frame component to the window frame.

21. The exterior window treatment system of claim 13, wherein the treatment storage housing is integral to the at least one housing interface frame component.

22. The exterior window treatment system of claim 13, further comprising a window treatment deployment assembly wherein an exterior window treatment housing includes a mounting feature configured to engage at least one of the window frame and a portion of a wall adjacent the window frame.

23. The exterior window treatment system of claim 22, wherein the window treatment deployment assembly comprises a spool and the exterior window treatment comprises a blind, wherein the spool is rotatable to wrap the blind onto the spool to move the blind into the stored position and unfurl the blind from the spool to the deployed position.

24. The exterior window treatment system of claim 13, wherein the exterior window treatment includes at least one exterior cover element engagable to the at least one housing interface frame component.

25. A method of integrating an exterior window treatment system with a window frame, comprising:

positioning a window frame in a wall opening;

providing a window treatment housing including an exterior window treatment movable between a stored position and a deployed position;

coupling at least one housing interface frame component to the window treatment housing, each housing interface frame component including a frame attachment feature; and coupling the frame attachment feature to the window frame to attach the window treatment housing to the window frame, wherein the frame attachment feature aligns the window treatment housing with the window frame.

26. The method of claim 25, further comprising:

coupling at least one guide interface frame component to the window frame, each guide interface frame component including at least one treatment guide engagable to the exterior window treatment to guide the exterior window treatment between the stored position and the deployed position.

27. The method of claim 26, wherein coupling the at least one guide interface frame component to the window frame includes coupling the frame attachment feature to the window, the at least one guide interface frame component coupled with the frame attachment feature, wherein the frame attachment feature aligns the at least one guide interface frame component and the at least one treatment guide with the window frame.

28. The method of claim 25, further comprising:

coupling frame cladding to an edge portion of the window frame, the frame cladding including an interface engagement feature engagable by the frame attachment feature.

29. The method of claim 25, further comprising:

coupling an exterior cover element to the at least one housing interface frame component.

30. The method of claim 25, further comprising:

positioning a treatment deployment assembly in the treatment housing, the treatment deployment assembly comprising a spool rotatable to move the exterior window treatment between the open position and closed position, the exterior window treatment comprising a blind.

* * * * *